US007703292B2

(12) United States Patent
Cook et al.

(10) Patent No.: US 7,703,292 B2
(45) Date of Patent: Apr. 27, 2010

(54) APPARATUS AND METHOD FOR INCREASING ICE PRODUCTION RATE

(75) Inventors: David Cook, Prospect, KY (US); Ramesh Janardhanam, Louisville, KY (US); Natarajan Venkatakrishnan, Louisville, KY (US)

(73) Assignee: General Electric Company, Schenectady, NY (US)

( * ) Notice: Subject to any disclaimer, the term of this patent is extended or adjusted under 35 U.S.C. 154(b) by 737 days.

(21) Appl. No.: 11/495,281

(22) Filed: Jul. 28, 2006

(65) Prior Publication Data

US 2008/0022703 A1 Jan. 31, 2008

(51) Int. Cl.
*F25C 1/00* (2006.01)
*G05D 23/32* (2006.01)

(52) U.S. Cl. ..... 62/135; 62/157

(58) Field of Classification Search ..... 62/135, 62/157, 158, 66, 389
See application file for complete search history.

(56) References Cited

U.S. PATENT DOCUMENTS 4,527,401 A 7/1985 Nelson
4,706,466 A 11/1987 Yingst et al.
4,852,359 A 8/1989 Manzotti
5,375,432 A 12/1994 Cur
5,950,449 A * 9/1999 Park et al. ..... 62/408
6,176,099 B1 1/2001 Hynes
6,474,094 B2 11/2002 Kim
6,691,529 B2 2/2004 Sugie et al.
6,782,706 B2 * 8/2004 Holmes et al. ..... 62/229
7,185,507 B2 3/2007 Maglinger et al.
7,204,092 B2 4/2007 Azcarate Castrellon et al.
2003/0140639 A1 * 7/2003 Gray et al. ..... 62/157
2005/0132739 A1 * 6/2005 Sannasi et al. ..... 62/344

FOREIGN PATENT DOCUMENTS

JP 2005076980 A * 3/2005

* cited by examiner

*Primary Examiner*—Chen-Wen Jiang
(74) *Attorney, Agent, or Firm*—George L. Rideout, Esq.; Armstrong Teasdale LLP

(57) ABSTRACT

A refrigerator includes a housing defining a freezer storage compartment, an evaporator operatively coupled to the freezer storage compartment and configured to cool the freezer storage compartment, and an evaporator fan positioned to move air across the evaporator. The refrigerator also includes an ice maker positioned within the freezer storage compartment, a dispenser in flow communication with the ice maker and configured to dispense ice, and a control system configured to receive a signal from said dispenser indicating dispensing of a first amount of ice from the dispenser, the control system configured to activate the evaporator fan in response to the signal, the evaporator fan operating continuously for a time period upon activation.

20 Claims, 3 Drawing Sheets

APPARATUS AND METHOD FOR INCREASING ICE PRODUCTION RATE

BACKGROUND OF THE INVENTION

This invention relates generally to refrigerators and, more particularly, to ice making assemblies for refrigerators.

Some known domestic refrigerators include an ice making assembly in a freezer storage compartment of the refrigerator. The ice making assembly generally includes a water reservoir into which water is supplied. The water is then frozen to form ice pieces or cubes. The ice pieces are then moved to a storage bin where they are held until a user accesses ice from the refrigerator through an ice dispenser typically mounted through the door of the refrigerator.

When a user obtains ice through the ice dispenser in the door of the refrigerator, a button is usually pressed which controls the delivery of the ice from the storage bin to the user. In certain instances, the ice storage bin may not hold a sufficient amount of ice to meet the demands of the user. Accordingly, the user has to wait for the ice making assembly to make more ice. The time required to make ice is dependent upon many factors including the temperature of water supplied to the ice making reservoir and the principles of convection.

Some consumers are interested in refrigerators having a highly efficient ice making assembly. In response to consumer demands, conventional attempts to resolve such ice producing problems have included adding an additional fan to increase convection of cool air within the ice making assembly and/or adding additional hardware, which undesirably increase the cost of manufacturing the refrigerator.

BRIEF DESCRIPTION OF THE INVENTION

In one aspect, an ice making assembly for an appliance is provided. The appliance includes a freezer storage compartment, an evaporator positioned within the freezer storage compartment and a fan positioned with respect to the evaporator and configured to move air across the evaporator. The ice making assembly includes an ice maker at least partially positioned within the freezer storage compartment. A dispenser is in flow communication with the ice maker. The dispenser is configured to dispense ice. A control system is operatively coupled to the ice maker and the dispenser. The control system is configured to receive a signal from the dispenser indicating an activation of the dispenser to dispense a first amount of ice. The control system is in operational communication with the fan and configured to activate the fan in response to the signal. Upon activation, the fan operates continuously for a selected time period.

In another aspect, an appliance is provided. The appliance includes a housing defining a freezer storage compartment. An evaporator is positioned within the freezer storage compartment. The evaporator is configured to cool the freezer storage compartment. A fan is positioned with respect to the evaporator and configured to move air across the evaporator. An ice maker is mounted within the freezer storage compartment and operatively coupled to the evaporator. A dispenser is in flow communication with the ice maker. The dispenser is configured to dispense ice. A sensor is operatively coupled to the dispenser and configured to detect an activation of the dispenser to dispense ice. A controller is in operational communication with the fan. The controller activates the fan in response to the sensor transmitting a signal to the controller indicating an activation of the dispenser to dispense ice.

In another aspect, a method for increasing an ice production rate within an appliance is provided. The method includes providing a housing defining a freezer storage compartment. An evaporator and a fan are positioned within the freezer storage compartment. The fan is positioned with respect to the evaporator and configured to move air across the evaporator in response to a signal received from a controller in operational communication with the fan. An ice maker is positioned within the freezer storage compartment. A dispenser is arranged in flow communication with the ice maker. The dispenser is configured to dispense ice. A sensor is operatively coupled to the dispenser. The sensor is configured to detect an activation of the dispenser to dispense an amount of ice. The fan is activated to operate continuously for a selected time period in response to the activation of the dispenser.

DETAILED DESCRIPTION OF THE INVENTION

Figure 1:
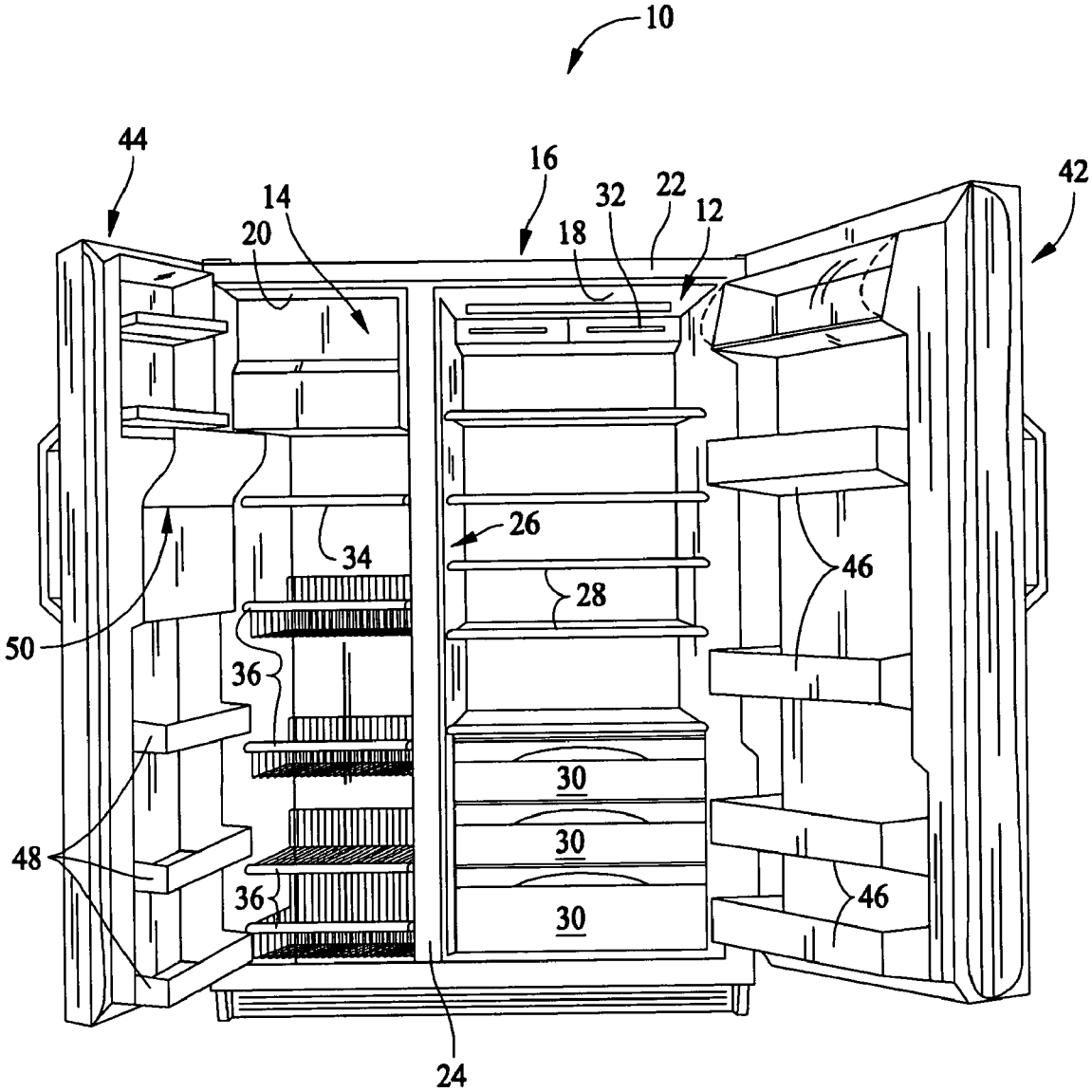
FIG. 1 is a perspective view of an exemplary refrigerator.

FIG. 1 illustrates an exemplary refrigeration appliance 10 in which the present invention may be practiced. In the embodiment described and illustrated herein, appliance 10 is a side-by-side refrigerator. It is recognized, however, that the benefits of the present invention are equally applicable to other types of refrigerators, freezers and refrigeration appliances. Consequently, the description set forth herein is for illustrative purposes only and is not intended to limit the invention in any aspect.

Refrigerator 10 includes a fresh food storage compartment 12 and a freezer storage compartment 14. Fresh food storage compartment 12 and freezer storage compartment 14 are arranged side-by-side within an outer case 16 and defined by inner liners 18 and 20 therein. A space between case 16 and liners 18 and 20, and between liners 18 and 20, is filled with foamed-in-place insulation. Outer case 16 normally is formed by folding a sheet of a suitable material, such as pre-painted steel, into an inverted U-shape to form top and side walls of case 16. A bottom wall of case 16 normally is formed separately and attached to the case side walls and to a bottom frame that provides support for refrigerator 10. Inner liners 18 and 20 are molded from a suitable plastic material to form fresh food storage compartment 12 and freezer storage compartment 14, respectively. Alternatively, liners 18, 20 may be formed by bending and welding a sheet of a suitable metal, such as steel. The illustrative embodiment includes two separate liners 18, 20 as it is a relatively large capacity unit and separate liners add strength and are easier to maintain within manufacturing tolerances. In smaller refrigerators, a single liner is formed and a mullion spans between opposite sides of the liner to divide it into a freezer storage compartment and a fresh food storage compartment.

A breaker strip 22 extends between a case front flange and outer front edges of liners 18, 20. Breaker strip 22 is formed from a suitable resilient material, such as an extruded acrylo-butadiene-styrene based material (commonly referred to as ABS).

The insulation in the space between liners 18, 20 is covered by another strip of suitable resilient material, which also commonly is referred to as a mullion 24. In one embodiment, mullion 24 is formed of an extruded ABS material. Breaker strip 22 and mullion 24 form a front face, and extend completely around inner peripheral edges of case 16 and vertically between liners 18, 20. Mullion 24, insulation between compartments, and a spaced wall of liners separating compartments, sometimes are collectively referred to herein as a center mullion wall 26.

In addition, refrigerator 10 includes shelves 28 and slide-out storage drawers 30, sometimes referred to as storage pans, which normally are provided in fresh food storage compartment 12 to support items being stored therein.

Operation of refrigerator 10 is monitored and/or controlled by a microprocessor, as described in greater detail below, according to user preference via manipulation of a control interface 32 mounted in an upper region of fresh food storage compartment 12 and operatively coupled to the microprocessor. A shelf 34 and wire baskets 36 are also provided in freezer storage compartment 14. In one embodiment, an ice making assembly 38 is positioned within freezer storage compartment 14.

A fresh food door 42 and freezer door 44 provide access to fresh food storage compartment 12 and freezer storage compartment 14, respectively. Each door 42, 44 is mounted to rotate between an open position, as shown in FIG. 1, and a closed position (not shown) preventing access to the corresponding compartment. Fresh food door 42 includes at least one storage shelf 46 and freezer door 44 includes at least one storage shelf 48.

Figure 3:
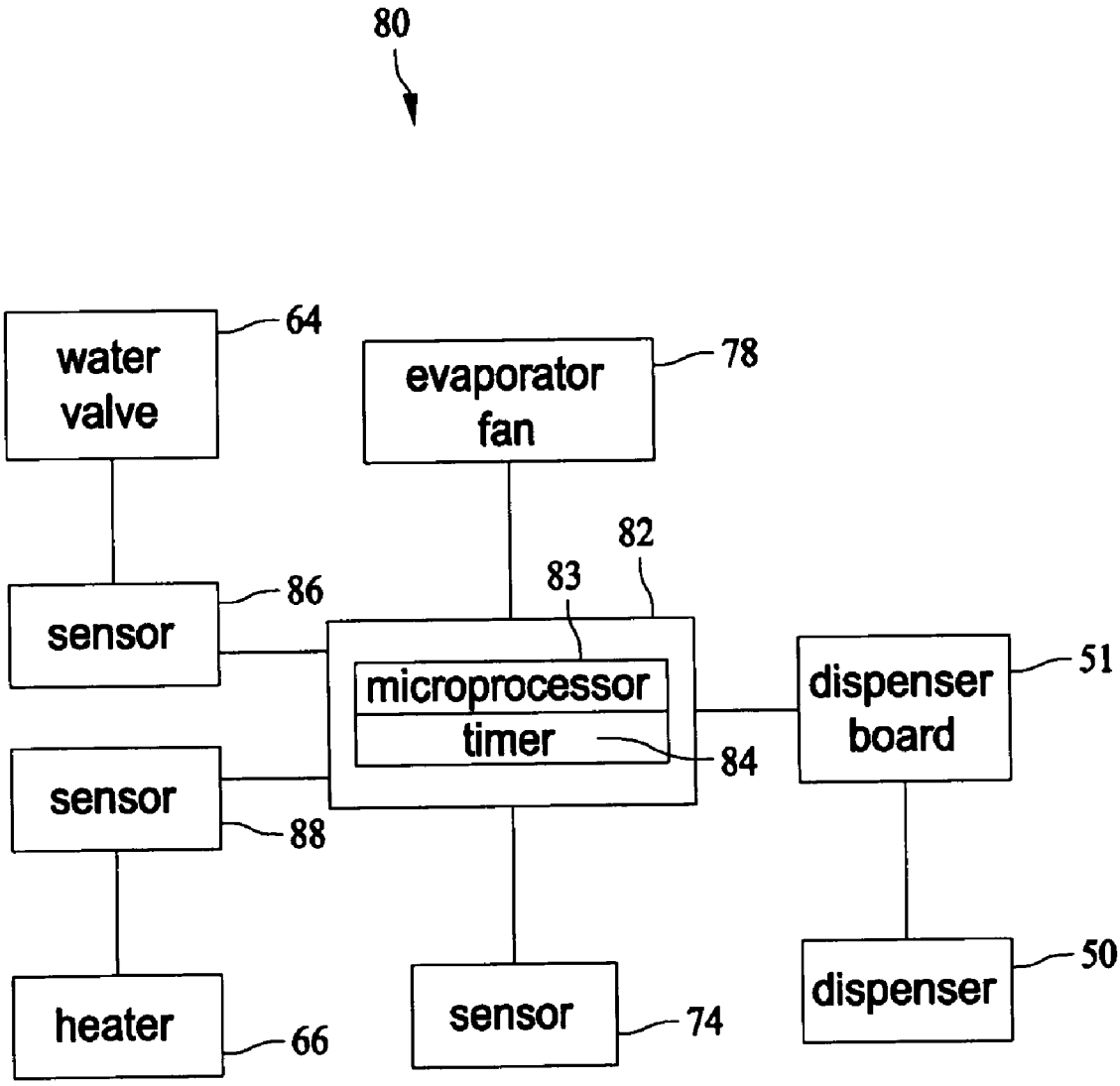
FIG. 3 is a schematic view of a control system for the ice making assembly shown in FIG. 2.

In one embodiment, ice making assembly 38 includes an ice maker 49 and a dispenser 50 in flow communication with ice maker 39. Dispenser 50 is configured to dispense ice to a user through freezer door 44 in response to the user's desired or selected operation. In a particular embodiment, dispenser 50 is at least partially positioned on the inner wall of freezer door 44, as shown in FIG. 1. Dispenser 50 further includes a dispenser board 51, as shown in FIG. 3, in electrical communication with dispenser 50 and the microprocessor. Dispenser board 51 is configured to transmit or relay signals between dispenser 50 and the microprocessor, for example upon activation of dispenser 50 by the user, as described in greater detail below.

Figure 2:
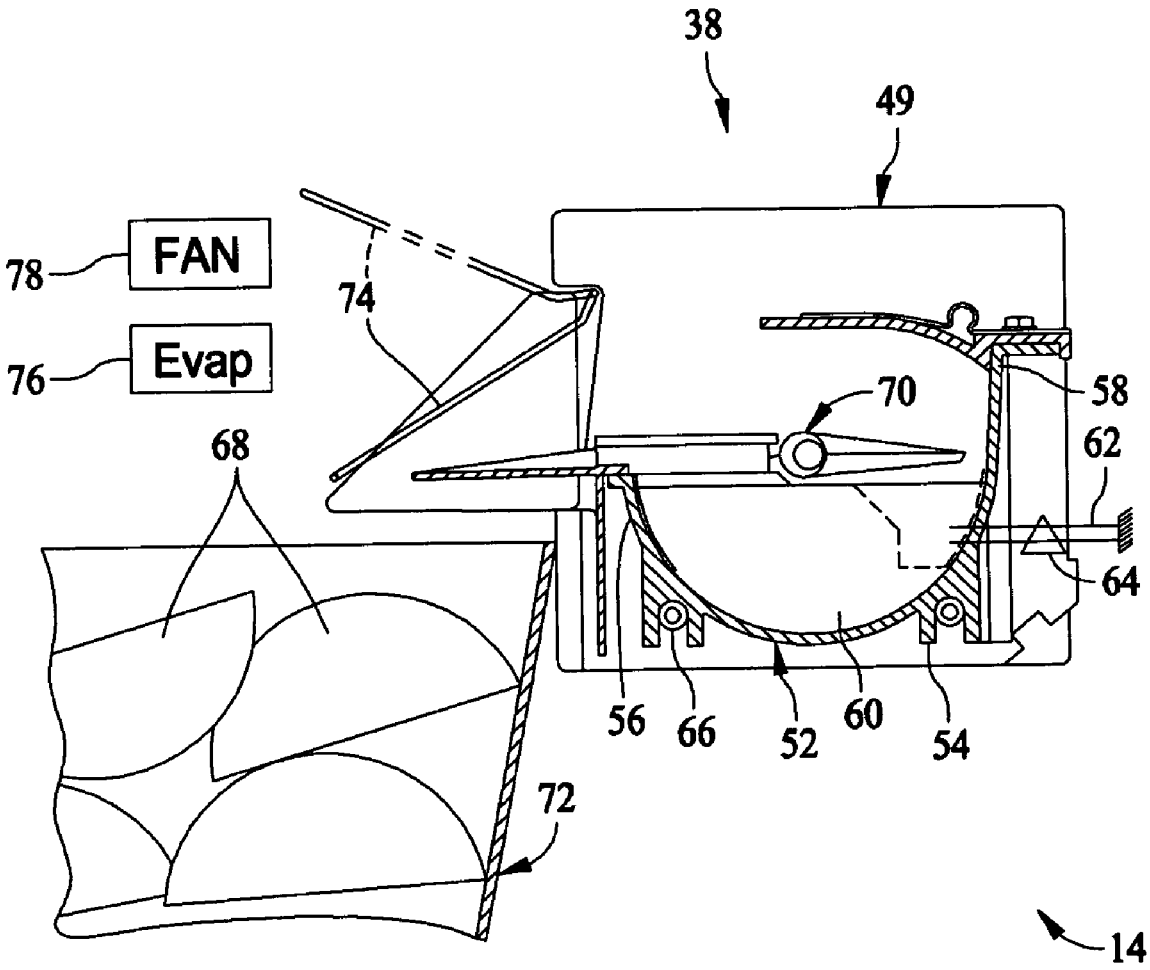
FIG. 2 is a partial sectional view of an ice making assembly located within a freezer storage compartment of the refrigerator shown in FIG. 1.

FIG. 2 is a partial sectional view of ice making assembly 38 that is positioned within freezer storage compartment 14. Ice making assembly 38 includes a mold 52 made of a suitable material including, without limitation a metal, composite or plastic material. Mold 52 forms a bottom wall 54, a front wall 56 and a back wall 58. A plurality of partition walls 60 extend transversely across mold 52 to define cavities for containing water therein for freezing into ice. Water is supplied into mold 52 through a water supply 62 that includes a valve 64 operatively coupled to control interface 32 and/or the microprocessor. Valve 64 is configured for facilitating a flow of water into each cavity defined within mold 52. Further, valve 64 is operatively coupled to the microprocessor to precisely control a quantity of water supplied to each cavity based on control communication or instructions from control interface 32.

A heater 66 is positioned with respect to mold 52 and configured for facilitating harvesting ice formed within mold 52. More particularly, heater 66 is attached to bottom wall 54 and heats mold 52 when a harvest cycle is executed to slightly melt ice pieces 68 and release each ice piece 68 from a respective mold cavity. A rotating rake 70 sweeps through mold 52 as ice is harvested and ejects ice piece 68 from mold 52 into an ice bucket 72, shown in FIG. 2. In one embodiment, a sensor 74, such as a spring-loaded feeler art, is at least partially positioned within ice bucket 72 to detect an amount of ice within ice bucket 72 at a selected or desired level. The operation of heater 66, sensor 74 and rake 70 is well known in the art and therefore not described in detail herein.

Ice making assembly 38 includes an evaporator 76 that is operatively coupled to refrigerator components (not shown) for executing a known vapor compression cycle for cooling air. In one embodiment, evaporator 76 is located within freezer storage compartment 14. In this embodiment, evaporator 76 is a type of heat exchanger that transfers heat from air passing over evaporator 76 to a refrigerant flowing through evaporator 76, thereby causing the refrigerant to vaporize. The cooled air is used to refrigerate freezer storage compartment 14 with an evaporator fan 78 positioned with respect to evaporator 76 and configured to move air across evaporator 76.

FIG. 3 is a schematic view of a control system 80 for refrigerator 10. Control system 80 includes a controller 82 having a microprocessor 83 and a timer 84. In alternative embodiments, control system 80 may include any suitable timer including, without limitation, an electronic, mechanical or electromechanical timer device. Control system 80 also includes a first sensor 86 through which water valve 64 is operatively coupled to controller 82 and a second sensor 88 through which heater 66 is operatively coupled to controller 82. In one embodiment, sensor 74 is also operatively coupled to controller 82. As described above, dispenser board 51 is in electrical communication with controller 82 and dispenser 50. In one embodiment, dispenser board 51 transmits a feedback signal to controller 82 upon the activation of dispenser 50 to initiate dispensing a first amount of ice from ice bucket 72. Upon dispenser 50 initiating dispensing the first amount of ice, controller 82 activates evaporator fan 78 to continuously operate for a selected time period to provide additional cooling to ice maker 49. In one embodiment, the selected time period is about 12 hours to about 24 hours. In alternative embodiments, the selected time period is less than about 12 hours or greater than about 24 hours, as required in accordance with the present invention.

As evaporator fan 78 continuously operates for the selected time period, ice maker 49 fills ice bucket 72 with ice pieces 68 to a selected level, such as a full capacity level. In one embodiment, if dispenser 50 dispenses a second amount of ice from ice bucket 72, timer 84 is reset and evaporator fan 78 continues to operate until ice pieces 68 are deposited within ice bucket 72 to the selected level.

In one embodiment, sensor 86 detects or senses activation of water valve 64 for facilitating water flow into mold 52. In response to the activation of water valve 64, sensor 86 transmits a feedback signal is sent to controller 82 which then commands or initiates evaporator fan 78 to operate for a selected time period to provide an additional cooling to ice maker 49. In one embodiment, the selected time period is about 30 minutes to about 90 minutes. In alternative embodiments, the selected time period is less than about 30 minutes or greater than about 90 minutes, as required in accordance with the present invention. In a particular embodiment, each time water valve 64 cycles to supply water to ice maker 49, timer 84 is reset and evaporator fan 78 continues to operate for the selected time period. When ice pieces 68 within ice bucket 72 reach or approach a selected level, controller 82 initiates water valve 64 to close and discontinue cycling, as well as resetting timer 84 to an initial position.

In a further embodiment, sensor 88 detects or senses the cycling of heater 66. In response to the cycling of heater 66, sensor 88 transmits a feedback signal to controller 82 which then commands or initiates evaporator fan 78 to operate for a selected time period to provide additional cooling to ice maker 49. However, when heater 66 is operating to facilitate harvesting ice from mold 52, evaporator fan 78 does not operate, which allows ice pieces 68 to be harvested faster. In one embodiment, the selected time period is about 30 minutes to about 90 minutes. In alternative embodiments, the selected time period is less than about 30 minutes or greater than about 90 minutes, as required in accordance with the present invention. In a particular embodiment, each time sensor 88 senses an additional ice harvest cycle, timer 84 is reset and evaporator fan 78 continues to operate for the selected time period. When ice pieces 68 within ice bucket 72 reach or approach a selected level, controller 82 discontinues ice maker 49 to prevent harvesting of additional ice pieces and evaporator fan 78 resumes normal operation after timer 84 has expired.

In one embodiment, any cycling of dispenser, heater and/or water valve is sensed by control system 80. In a particular embodiment, a feedback signal or other suitable signal is transmitted from dispenser board 51 or respective sensor 86, 88 to control system 80 indicating commencement of a cycling event. In response to the signal, control system 80 activates evaporator fan 78 to operate for a selected time period to provide additional cooling to ice maker 49. In this embodiment, when a user's demand for more ice is detected or sensed, the operating parameters of freezer storage compartment 14 are changed to maximize an ice production rate. As such, energy efficiency is greatly improved with no additional product cost and/or negative impact on energy consumption by automatically making more ice based on the demand from the consumer.

While the invention has been described in terms of various specific embodiments, those skilled in the art will recognize that the invention can be practiced with modification within the spirit and scope of the claims.

What is claimed is:

1. An ice making assembly for an appliance comprising a freezer storage compartment, the appliance comprising an evaporator positioned within the freezer storage compartment and a fan positioned with respect to the evaporator and configured to move air across the evaporator, said ice making assembly comprising:

an ice maker at least partially positioned within the freezer storage compartment;

a dispenser in flow communication with said ice maker, said dispenser configured to dispense ice; and a control system operatively coupled to said ice maker and said dispenser, said control system configured to receive a signal from said dispenser indicating an activation of said dispenser to dispense a first amount of ice, said control system in operational communication with the fan and configured to activate the fan in response to said signal, upon activation the fan operating continuously for a selected time period to facilitate providing additional cooling to said ice maker.

2. The ice making assembly in accordance with claim 1 further comprising a dispenser board operatively coupling said dispenser to said control system, said dispenser board configured to generate said signal in response to the activation of said dispenser to dispense the first amount of ice and transmit the generated signal to said control system.

3. The ice making assembly in accordance with claim 1 wherein said control system further comprises:

a microprocessor operatively coupled to the fan, said microprocessor configured to initiate operation of the fan in response to receiving said signal; and a timer operatively coupled to said microprocessor, said timer configured to continuously operate the fan for the selected time period.

4. The ice making assembly in accordance with claim 3 wherein said timer is reset upon said dispenser dispensing a second amount of ice.

5. The ice making assembly in accordance with claim 1 further comprising:

a mold comprising at least one cavity for containing water therein for freezing into ice;

a water supply in flow communication with said mold, said water supply configured to supply an amount of water to said at least one cavity;

a valve operatively coupled to said water supply, said valve configured to control a flow of water into said mold; and a first sensor positioned with respect to said valve and in electrical communication with said control system, said control system configured to activate said fan for the selected time period in response to receiving a signal from said first sensor indicating an activation of said valve to supply an amount of water to said at least one cavity.

6. The ice making assembly in accordance with claim 5 wherein said control system further comprises a timer operatively coupled to said fan, said timer configured to operate said fan continuously for the selected time period.

7. The ice making assembly in accordance with claim 6 wherein said timer is reset upon completion of a valve cycle.

8. The ice making assembly in accordance with claim 5 further comprising:

a heater positioned with respect to said mold and configured for facilitating harvesting ice formed within said mold; and a second sensor positioned with respect to said heater, said second sensor in electrical communication with said control system, said control system configured to activate the fan for the selected time period in response to receiving a signal from said second sensor indicating an activation of said heater.

9. The ice making assembly in accordance with claim 1 further comprising:

an ice bucket for containing ice produced by said ice maker; and a sensor positioned within said ice bucket, said sensor configured to detect an amount of ice within said ice bucket at a selected level.

10. An appliance comprising:

a housing defining a freezer storage compartment;

an evaporator positioned within said freezer storage compartment, said evaporator configured to cool said freezer storage compartment;

a fan positioned with respect to said evaporator and configured to move air across said evaporator;

an ice maker mounted within said freezer storage compartment and operatively coupled to said evaporator;

a dispenser in flow communication with said ice maker, said dispenser configured to dispense ice;

a sensor operatively coupled to said dispenser and configured to detect an activation of said dispenser to dispense ice; and a controller in operational communication with said fan, said controller activating said fan in response to said sensor transmitting a signal to said controller indicating an activation of said dispenser to dispense ice to facilitate providing additional cooling to said ice maker.

11. The appliance in accordance with claim 10 further comprising a dispenser board in electrical communication with said controller, said dispenser board transmitting a signal to said controller upon activation of said dispenser.

12. The appliance in accordance with claim 10 wherein said controller further comprises a timer operatively coupled to said fan, said timer configured to operate said fan continuously for a selected time period.

13. The appliance in accordance with claim 12 wherein said timer is reset upon an additional activation of said dispenser to dispense ice.

14. The appliance in accordance with claim 10 further comprising:

a mold comprising at least one cavity for containing water therein for freezing into ice;

a water supply in flow communication with said mold, said water supply configured to supply an amount of water to said at least one cavity;

a valve operatively coupled to said water supply, said valve configured to control a flow of water into said mold; and a second sensor positioned with respect to said valve and in electrical communication with said controller, said second sensor configured to detect an activation of said valve to supply water to said ice maker, said controller configured to activate said fan for a selected second time period in response to receiving a signal from said second sensor indicating an activation of said valve to supply water to said at least one cavity.

15. The appliance in accordance with claim 14 wherein said controller comprises a timer operatively coupled to said valve, said timer configured to operate said fan for the selected second time period.

16. The appliance in accordance with claim 15 wherein said timer is reset upon completion of a valve cycle.

17. The appliance in accordance with claim 10 further comprising:

a mold comprising at least one cavity for containing water therein for freezing into ice; and a heater positioned with respect to said mold, said controller configured to activate said fan for the selected time period upon activation of said heater.

18. A method for increasing an ice production rate within an appliance, said method comprising:

providing a housing defining a freezer storage compartment;

positioning an evaporator and a fan within the freezer storage compartment, the fan positioned with respect to the evaporator and configured to move air across the evaporator in response to a signal received from a controller in operational communication with the fan;

positioning an ice maker within the freezer storage compartment;

arranging a dispenser in flow communication with the ice maker, the dispenser configured to dispense ice;

operatively coupling a sensor to the dispenser, the sensor configured to detect an activation of the dispenser to dispense an amount of ice; and activating the fan to operate continuously for a selected time period in response to the activation of the dispenser to facilitate providing additional cooling to the ice maker.

19. The method in accordance with claim 18 further comprising operatively coupling a timer to the controller, the timer configured to operate the fan for the selected time period.

20. The method in accordance with claim 18 further comprising providing a valve to control water supply into the ice maker, wherein the controller activates the fan to operate continuously for the selected time period upon receiving a signal from the controller indicating activation of the valve.

* * * * *